US008001911B2

(12) United States Patent
Yankello et al.

(10) Patent No.: US 8,001,911 B2
(45) **Date of Patent: *Aug. 23, 2011**

(54) SHELVING UNIT

(75) Inventors: Joseph J. Yankello, Cornelius, NC (US); Robert John Warner, Jr., Charlotte, NC (US); David M. Stitchick, Akron, OH (US); Troy Andrew Richardson, California, KY (US); Stephen Biel, Milford, OH (US); Pete Werwick, Springboro, OH (US); Brett A. Hall, Huntersville, NC (US); Michael S. Kerley, Winston-Salem, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 188 days.

This patent is subject to a terminal disclaimer.

(21) Appl. No.: 12/247,458

(22) Filed: Oct. 8, 2008

(65) Prior Publication Data

US 2009/0242501 A1 Oct. 1, 2009

Related U.S. Application Data

(63) Continuation-in-part of application No. 11/733,222, filed on Apr. 10, 2007, now Pat. No. 7,658,154.

(60) Provisional application No. 60/881,206, filed on Jan. 19, 2007.

(51) Int. Cl.
*A47B 91/00* (2006.01)

(52) U.S. Cl. ..... 108/190; 108/192; 108/147.13

(58) Field of Classification Search ..... 108/190, 108/192, 193, 147.13, 147.15, 147.16, 147.17, 108/153.1, 180, 147.11, 42, 47, 48; 211/189, 211/206

See application file for complete search history.

(56) References Cited

U.S. PATENT DOCUMENTS

| | | | | |
|---|---|---|---|---|
| 3,831,533 | A * | 8/1974 | Kellogg | 108/64 |
| 4,158,336 | A * | 6/1979 | Brescia et al. | 108/190 |
| 4,383,528 | A | 5/1983 | Eppolito | |
| 4,501,512 | A * | 2/1985 | Hiltz | 403/170 |
| 4,600,033 | A | 7/1986 | Baron | |
| 4,706,576 | A * | 11/1987 | James | 108/192 |
| 4,735,154 | A * | 4/1988 | Hemery | 108/56.1 |
| 4,843,975 | A * | 7/1989 | Welsch et al. | 108/192 |
| 5,119,844 | A | 6/1992 | Cannon et al. | |

(Continued)

FOREIGN PATENT DOCUMENTS

EP 051238 11/1993

OTHER PUBLICATIONS

Patent Cooperation Treaty, Search Report, Jul. 1, 2008.

*Primary Examiner* — José V Chen

(74) *Attorney, Agent, or Firm* — Dennis J. Williamson; Moore & Van Allen, PLLC

(57) ABSTRACT

A shelf is connected to risers that are interference fit together to achieve a clamping effect between the shelves and the risers. Each shelf may comprise a plastic shelf portion and at least one reinforcement portion secured to the plastic shelf portion to reinforce the plastic shelf portion along its length. In one embodiment a plurality of metal bars are used as the reinforcement portion having a tapered end. The reinforcement portions may be inserted into channels formed in the plastic shelve portions and secured to the shelf portions using an interference fit.

15 Claims, 17 Drawing Sheets

U.S. PATENT DOCUMENTS 5,158,187 A * 10/1992 Taub ..... 108/190
5,671,503 A 9/1997 Uebelacker et al.
5,802,990 A * 9/1998 Lin ..... 108/192
5,868,080 A * 2/1999 Wyler et al. ..... 108/57.25
5,881,653 A * 3/1999 Pfister ..... 108/192
5,947,036 A * 9/1999 Cohen ..... 108/110
6,079,339 A * 6/2000 Houk et al. ..... 108/186
6,178,896 B1 1/2001 Houk, Jr. et al.
6,199,488 B1 * 3/2001 Favaron et al. ..... 108/57.25
6,357,366 B1 * 3/2002 Frankenberg ..... 108/57.25
6,622,642 B2 * 9/2003 Ohanesian ..... 108/57.25
6,820,757 B2 * 11/2004 Craft et al. ..... 211/188
6,892,651 B1 * 5/2005 Van Reed et al. ..... 108/56.1
6,908,000 B2 6/2005 Craft et al.
7,165,499 B2 * 1/2007 Apps et al. ..... 108/57.25
7,658,154 B2 * 2/2010 Yankello et al. ..... 108/190
2007/0071929 A1 3/2007 Haimoff

* cited by examiner

SHELVING UNIT

This application is a continuation-in-part of, and claims the benefit under 35 U.S.C. §120 of, U.S. application Ser. No. 11/733,222 filed Apr. 4, 2007 which claims the benefit of priority under 35 U.S.C. §119(e) to the filing date of U.S. Provisional Application Ser. No. 60/881,206 filed on Jan. 19, 2007, which are incorporated herein by reference in their entirety.

BACKGROUND

Shelving units consisting of vertical members that support a plurality of horizontally extending shelves are known. One type of shelving unit is a plastic unit where the vertical members and shelves are formed of a plastic material. The units are often manufactured, shipped and sold as disassembled kits where the end user connects the vertical members and shelves to assemble the complete shelving unit.

In order to provide structural strength over time and provide creep resistance, relatively thick shelves must be used. To create the desired thickness a large amount of resin is required. As the cost of resin increases, the cost of the shelving unit also increases. Further, because the shelves are relatively thick, the size of the disassembled shelving unit as a shipping cube is relatively large such that shipping costs are increased. Finally, the performance of plastic shelving units can be affected by changes in ambient temperature where extreme heat or cold can adversely affect the load capacity and strength of the unit.

All metal shelving units are also known. Such units are relatively heavy when compared to plastic units such that they may be difficult for the end user to transport and assemble. Further, all metal units are subject to rust and corrosion especially on the shelves themselves. Finally, the style and shape of metal units is typically limited due to the difficulty and expense of manufacturing complex metal shapes.

Thus an improved shelving unit is desired.

SUMMARY OF THE INVENTION

A shelf is connected to risers that are interference fit together to fix the shelves to the risers. Each shelf may comprise a plastic shelf portion and at least one reinforcement portion secured to the plastic shelf portion to reinforce the plastic shelf portion along its length. In one embodiment a plurality of metal bars are used as the reinforcement portion each having a tapered end. The reinforcement portions may be inserted into channels formed in the plastic shelve portions and may be secured to the shelve portions using an interference fit. The reinforcement portions may extend between the risers along the major length of the shelf.

DETAILED DESCRIPTION OF PREFERRED EMBODIMENTS OF THE INVENTION

Figure 1:
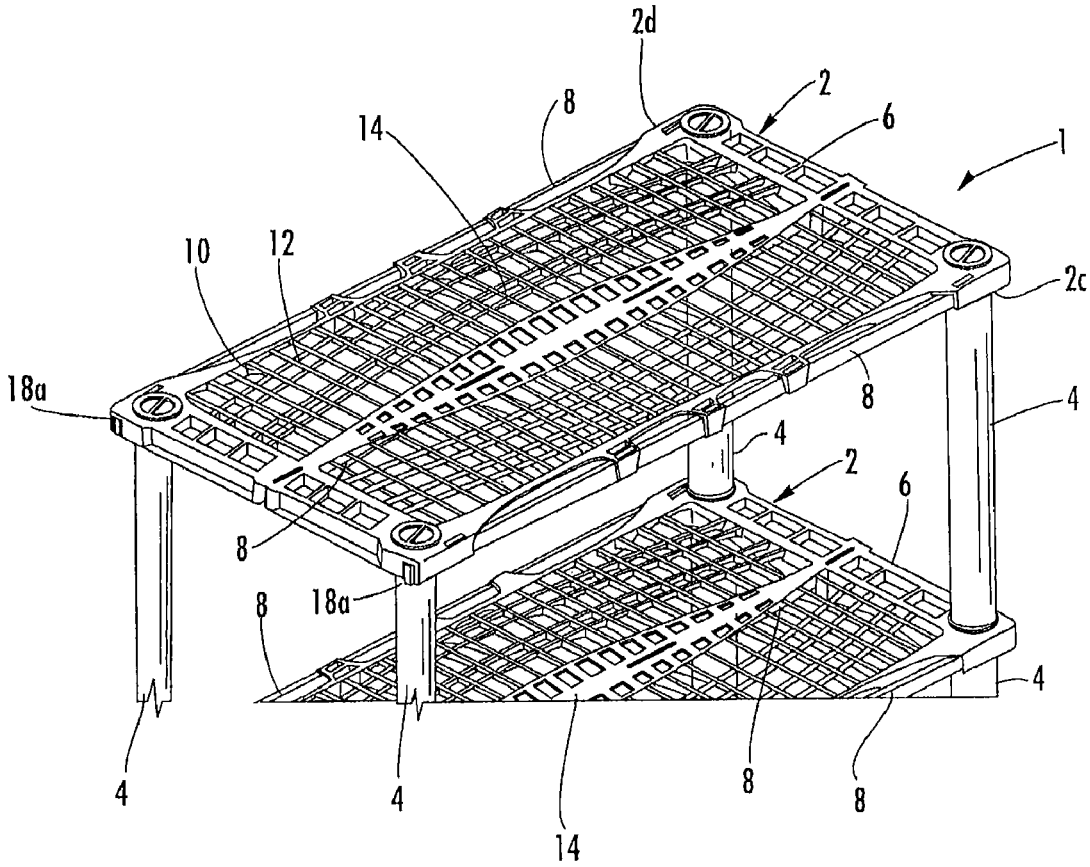
FIG. 1 is a partial perspective view of one embodiment of the shelving unit of the invention.
Figure 2:
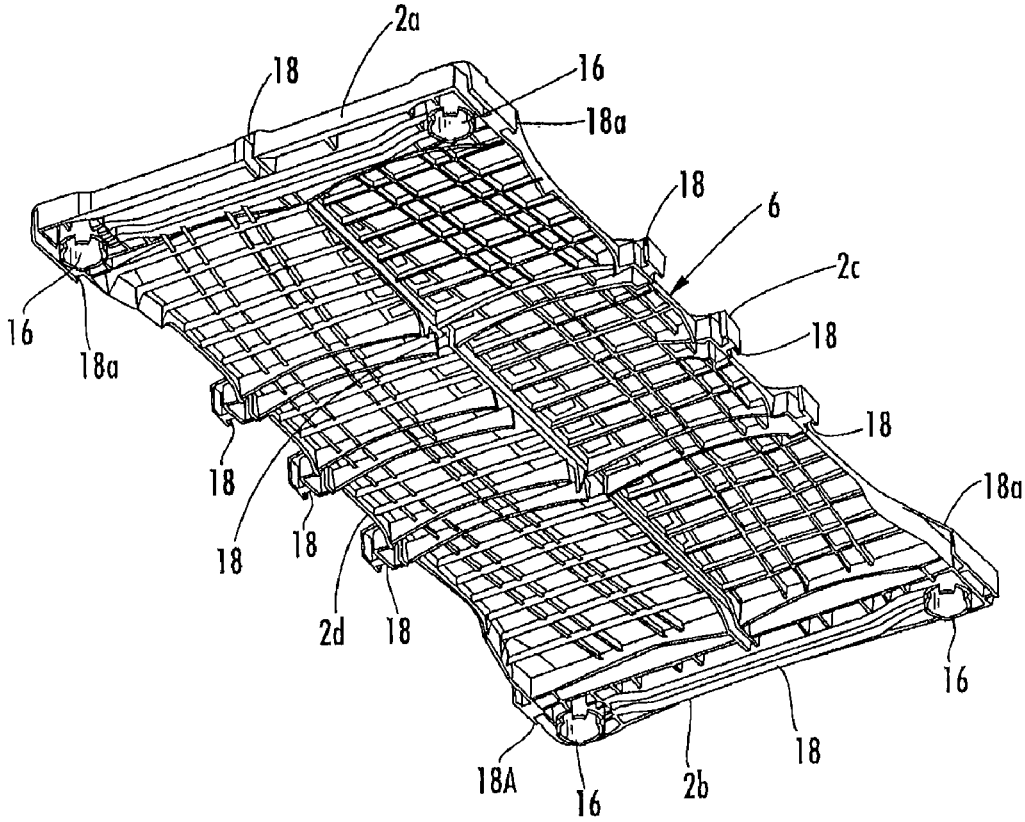
FIG. 2 is a perspective view showing the bottom of a shelf of the shelving unit of FIG. 1.
Figure 3:
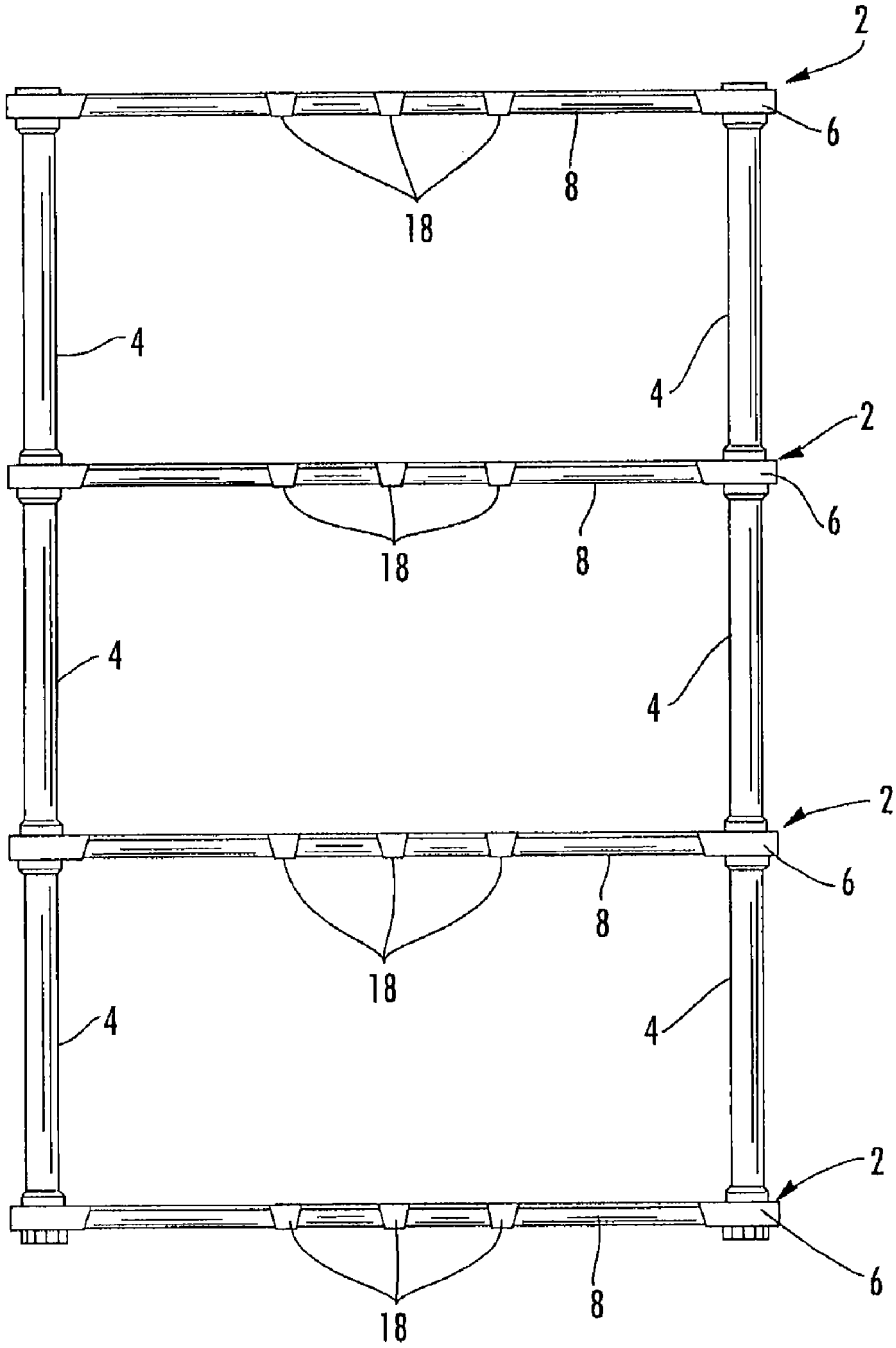
FIG. 3 is a front view of the shelving unit of FIG. 1.
Figure 4:
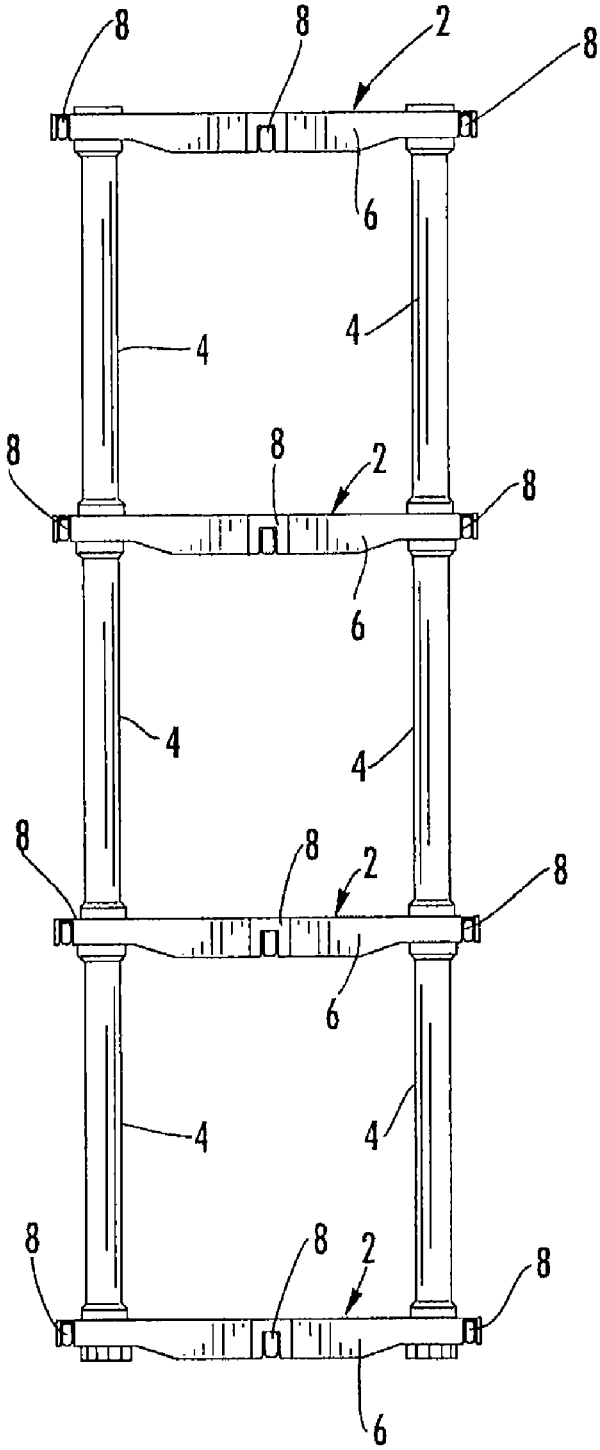
FIG. 4 is a side view of the shelving unit of FIG. 1.
Figure 5:
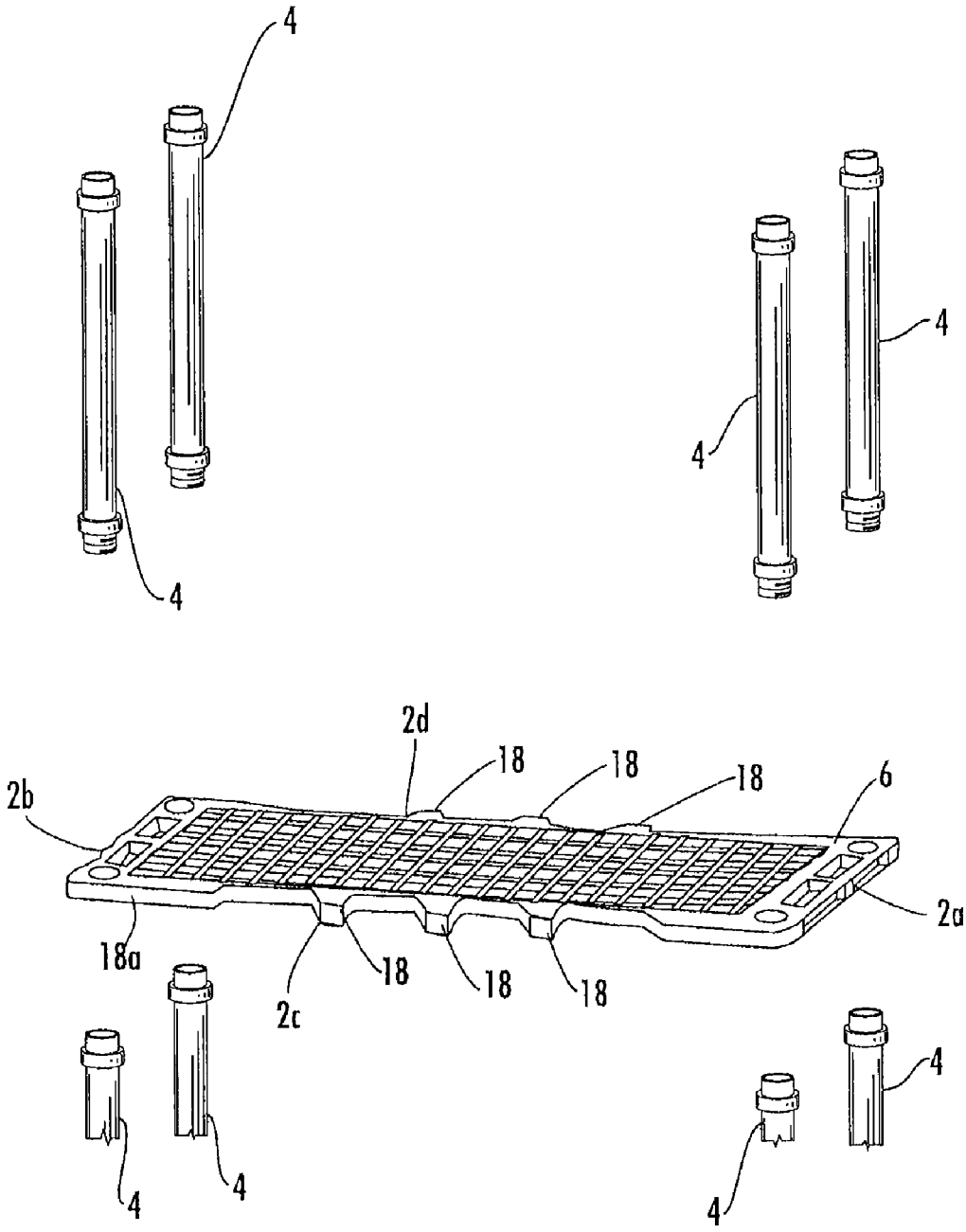
FIG. 5 is a partial exploded view of the shelving unit of FIG. 1.
Figure 6:
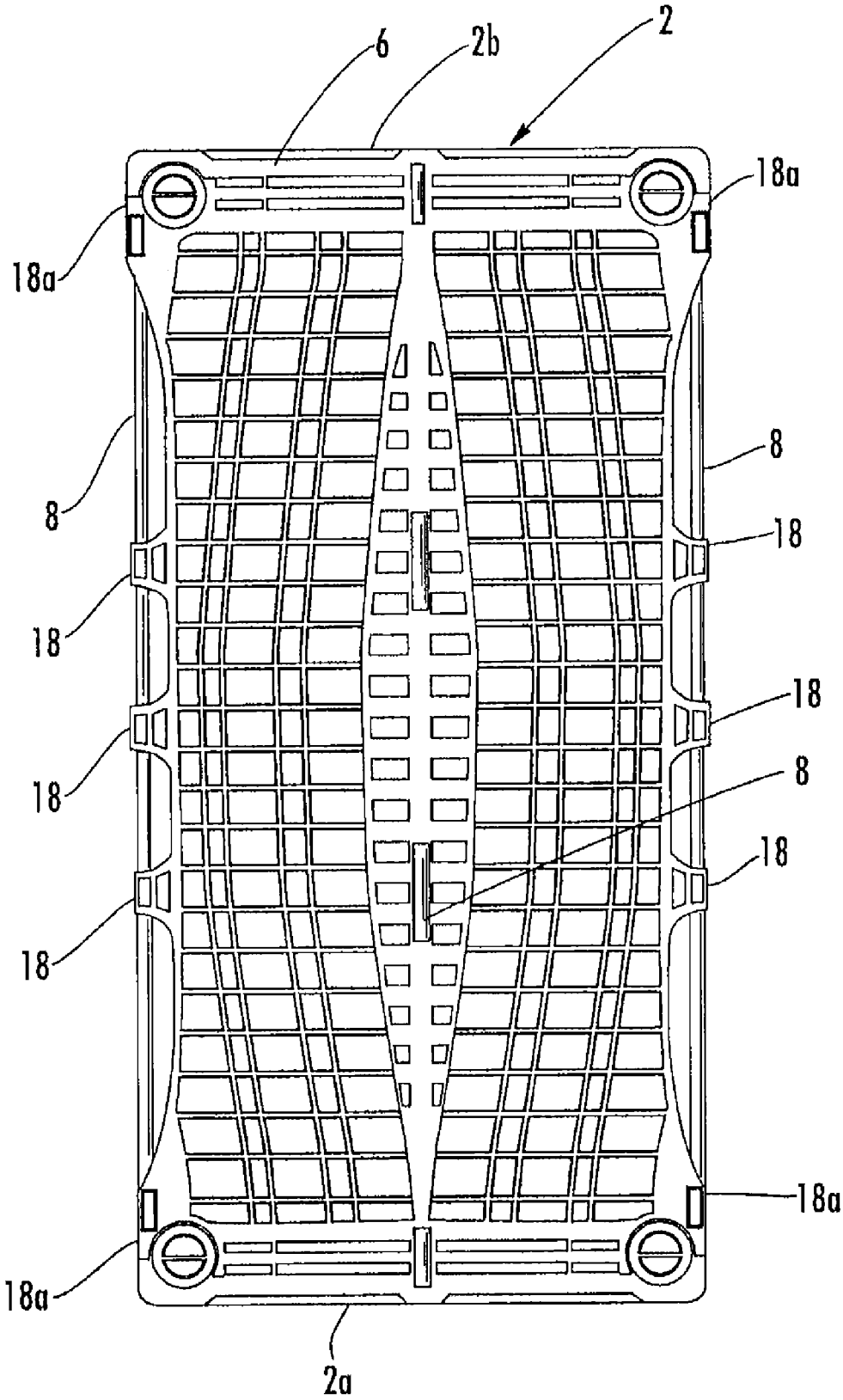
FIG. 6 is a top view of the shelving unit of FIG. 1.
Figure 7:
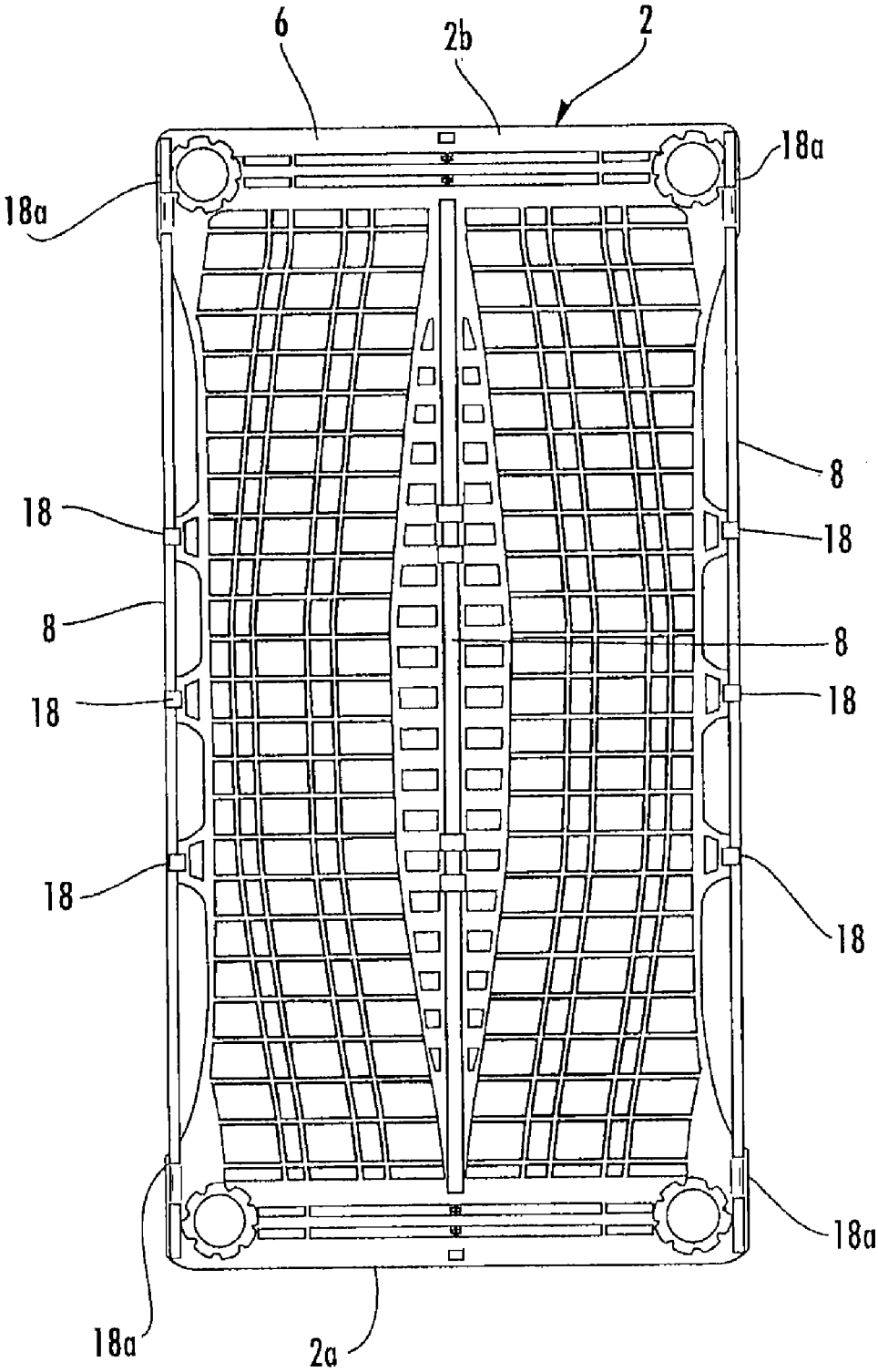
FIG. 7 is a bottom view of the shelving unit of FIG. 1.

The shelving unit is shown generally at 1 and comprises a plurality of shelves 2 supported by risers 4 to create a multi-layer shelving unit. The number of shelves 2 provided in the shelving unit 1 may vary. Each shelf 2 comprises a plastic shelf portion 6 and at least one separate reinforcement portion 8. The shelf portion 6 may be injection molded or otherwise manufactured from any suitable rigid plastic material and may be made in a variety of colors. Because the shelf portion 6 is a molded plastic piece it can be manufactured in a wide variety of shapes including relatively complex shapes such as the grating design shown in the figures where a series of intersecting members 10 and 12 create the load supporting surface 14 of the shelf. Using a grating design also allows the shelf portion 6 to be manufactured at less cost than a solid load supporting surface because less plastic material is used to create the shelf portion. While a particular shape of shelf portion 6 is shown it is to be understood that the shelf portion may have any shape and design. The supporting surface may also be made as a solid surface. The plastic portions of shelf portion 6 may also be made hollow to reduce the amount of material used.

Molded adjacent each corner of shelf portion 6 are mounting apertures 16 for receiving risers 4 that connect the shelves 2 to one another to create shelving unit 1. A greater or fewer number of mounting apertures 16 may be provided and they may be located at positions on the shelf 2 other than at the corners of the shelf including in the interior thereof. Further, if the shelves have a shape other than rectangular, such as circular or oval, the mounting apertures 16 may be positioned in a variety of locations. The mounting apertures 16 are used to clamp the risers 4 to one another and to the shelves 2 as will hereinafter be described.

Each shelf portion 6 also includes a plurality of channels 18 formed therein for receiving reinforcement portions 8. Each channel 18 is dimensioned to closely receive a reinforcement portion 8 to thereby retain the reinforcement portion in the shelf. The channels 18 are arranged as aligned sets of channels where each reinforcement portion 8 is received in each of the aligned channels of the set. The channels 18*a* located at the end of the shelf portion 6 are open to the exterior of the shelf such that the reinforcement portion 8 may be slid into the aligned channels from the exterior of the shelf 2. The reinforcement portions 8 may be inserted into the channels in a number of different ways including insert molding, post-molding or secondary operation, or by the consumers. In the illustrated embodiment a plurality of relatively short channels (as compared to the overall length of shelf 6) are used to minimize the amount of plastic material used. However, a single relatively large channel may be used in place of the plurality of aligned smaller channels. Further, while in the illustrated embodiment the reinforcement portion 8 is slid into the channels 18 it is to be understood that the channels may be formed to allow the reinforcement portion to be snapped into the channels. Further, the reinforcement portions 8 may be secured to the shelf portion 6 by using a separate mechanical fastener such as screws or bolts or the like or by using adhesive or a welding process such as a heat stake that attaches the reinforcement portions 8 to portions of the shelf portion 6. Further, the channels 18 may be used in conjunction with another attachment mechanism such that after the reinforcement portions 8 are inserted into channels 18 the reinforcement portions are attached to the shelf portion such as by mechanical connectors, adhesive, welding or the like.

The reinforcement portions 8 comprise bars of a rigid material such as metal or steel. In one embodiment the reinforcement portions comprise full hard steel as disclosed in U.S. patent application Ser. No. 11/439,157, which was filed on May 23, 2006, the entirety of which is hereby incorporated by reference, and U.S. Provisional Application Ser. No. 60/736,717, which was filed on Nov. 15, 2005, the entirety of which is hereby incorporated by reference. In the illustrated embodiment the bars have a relatively simple shape such as a rectangular bar that is easy to manufacture yet is strong and provides resistance to bending and torsion. While rectangular bars are shown, the reinforcement portions 8 may have other cross-sectional shapes.

Further, a strong, rigid material other than steel may also be used. While a straight bar may be the simplest and cheapest form of the reinforcement portions 8, it is to be understood that the reinforcement portions may be formed with more complicated shapes such as an I-shape or other open or closed sections.

Figure 13:
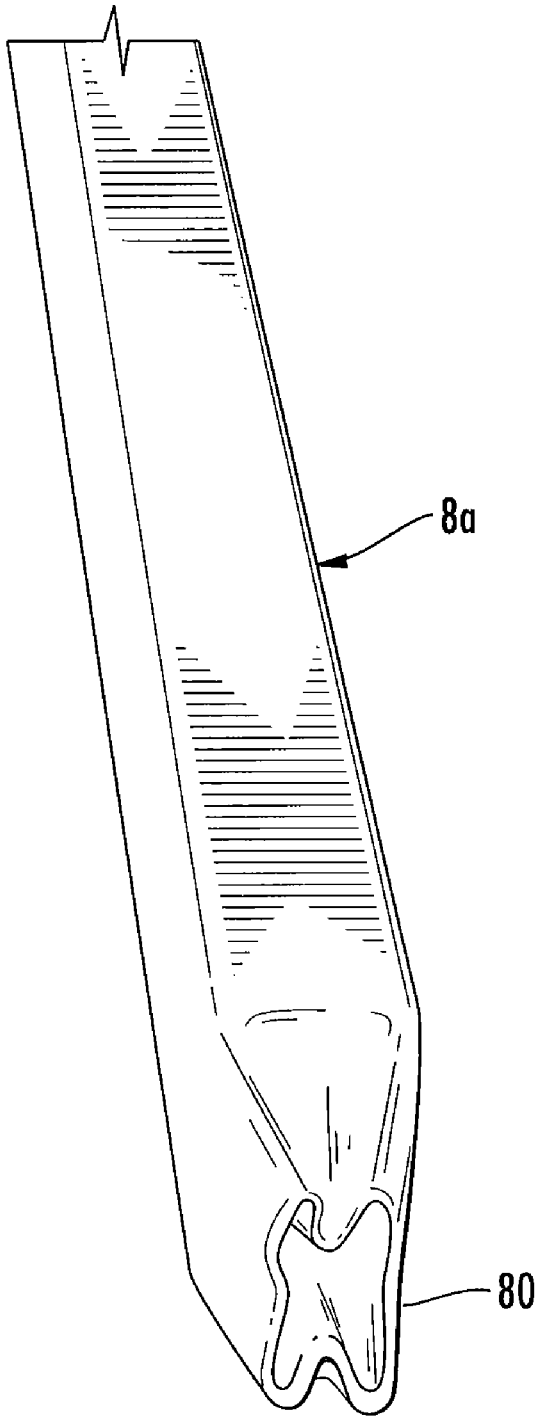
FIG. 13 is a perspective view of an alternate embodiment of the reinforcement portion of the shelf of the invention.

Referring to FIG. 13, an embodiment the reinforcement portion is shown generally at 8*a* comprising a hollow rectangular bar including a tapered area 80 at one end thereof where the tapered area 80 has an area of reduced cross-section. The reinforcement portion 8*a* may be formed with a tapered area 80 at each end thereof. The tapered area 80 may be created by bending or crimping the end of the hollow reinforcement portion 8*a*. The tapered area 80 extends for approximately 0.4 inches from the end of the reinforcement portion 8*a* and expands in cross-section from the end of the reinforcement portion 8*a* to the full cross-sectional area of the reinforcement portion. The tapered area 8*a* is inserted into channels 18 and the reinforcement portion 8 is dimensioned to create an interference fit in the channel 18.

As shown, the channels 18 are arranged such that the reinforcement portions 8 extend for substantially the length of the shelf along the long dimension thereof. The reinforcement portions 8 are used along the longest span because this is where deflection of the shelf under a load would be the greatest absent the reinforcement portions. While the reinforcement portions 8 extend along the long dimension it is to be understood that additional reinforcement portions may be used that extend for the short dimension of the shelf such as by locating reinforcement portions along the side edges 2*a* and 2*b* of shelf portion 6. Further, while three reinforcement portions 8 are shown one located along the front edge 2*c*, one located along the back edge 2*d* and one located along the centerline of the shelf portion between front edge 2*c* and back edge 2*d*, a greater or fewer number of reinforcement portions may be used depending upon the desired load bearing characteristics of the shelf. The reinforcement portions 8 that are located adjacent the mounting apertures 16 stabilize the connection between the risers and the shelves as described below. The reinforcement portion 8 located along the centerline of the shelf is used primarily to prevent the shelf from deflecting under a load and minimize the amount of resin needed in the middle of the shelf.

In the illustrated embodiment the reinforcement portions 8 extend substantially from side edge 2*a* to side edge 2*b* and extend parallel to one another although the reinforcement portions 8 may be arranged other than parallel to one another. The reinforcement portions 8 may extend beyond side edges 2*a* and 2*b* or they may terminate just short of the edges. In one embodiment the reinforcement portions 8 extend to at least the longitudinal axis of the risers 4. The reinforcement portions 8 are disposed as close to the mounting apertures 16 and risers 4 as possible such that the reinforcement portions stabilize the connection between the risers and the shelf to minimize deflection of the shelf. Stabilizing the connection between the risers 4 and the shelf 2 prevents the shelf from deflecting under a load and prevents the risers from tilting away from a true vertical orientation. As a result, a load on shelf 2 is directed along the longitudinal axis of the risers 4 where the risers have maximum strength and maximizes the load that can be supported by the risers without buckling.

Using the construction of the shelves described above, the overall height of the shelf may be reduced by 40-50% compared to an all plastic shelf of similar area and capacity. The amount of resin may be reduced by 65% compared to comparable all plastic shelves. By designing a thinner, lighter shelf shipping costs of the unit are also reduced. The shelves also provide plastic support surfaces that will not rust or corrode while providing a strong support surface.

To connect the shelves to one another, risers 4 are used where each riser comprises a hollow tube. While hollow tubes are lighter and use less material, solid risers may also be used. The risers between any two shelves are typically of uniform length such that the shelves are parallel; however, risers between different shelves may be of different lengths such that the distance between shelves may vary.

Figure 8:
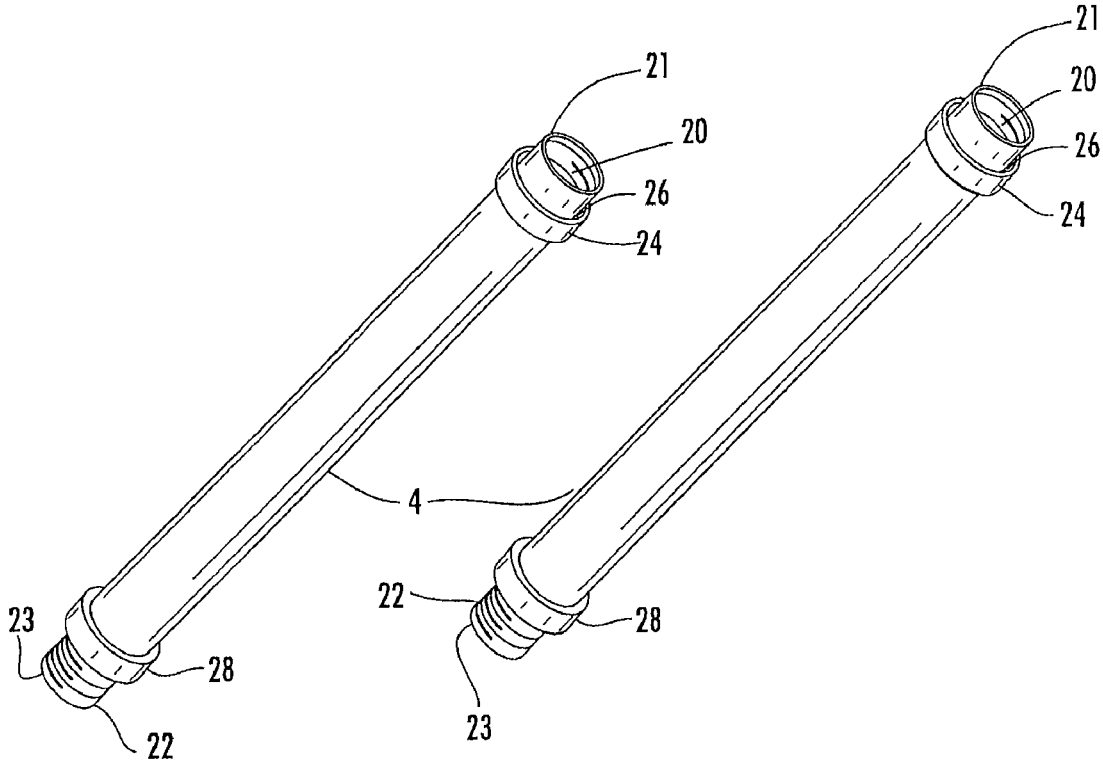
FIG. 8 is a perspective view showing the risers of the shelving unit of FIG. 1.
Figure 9:
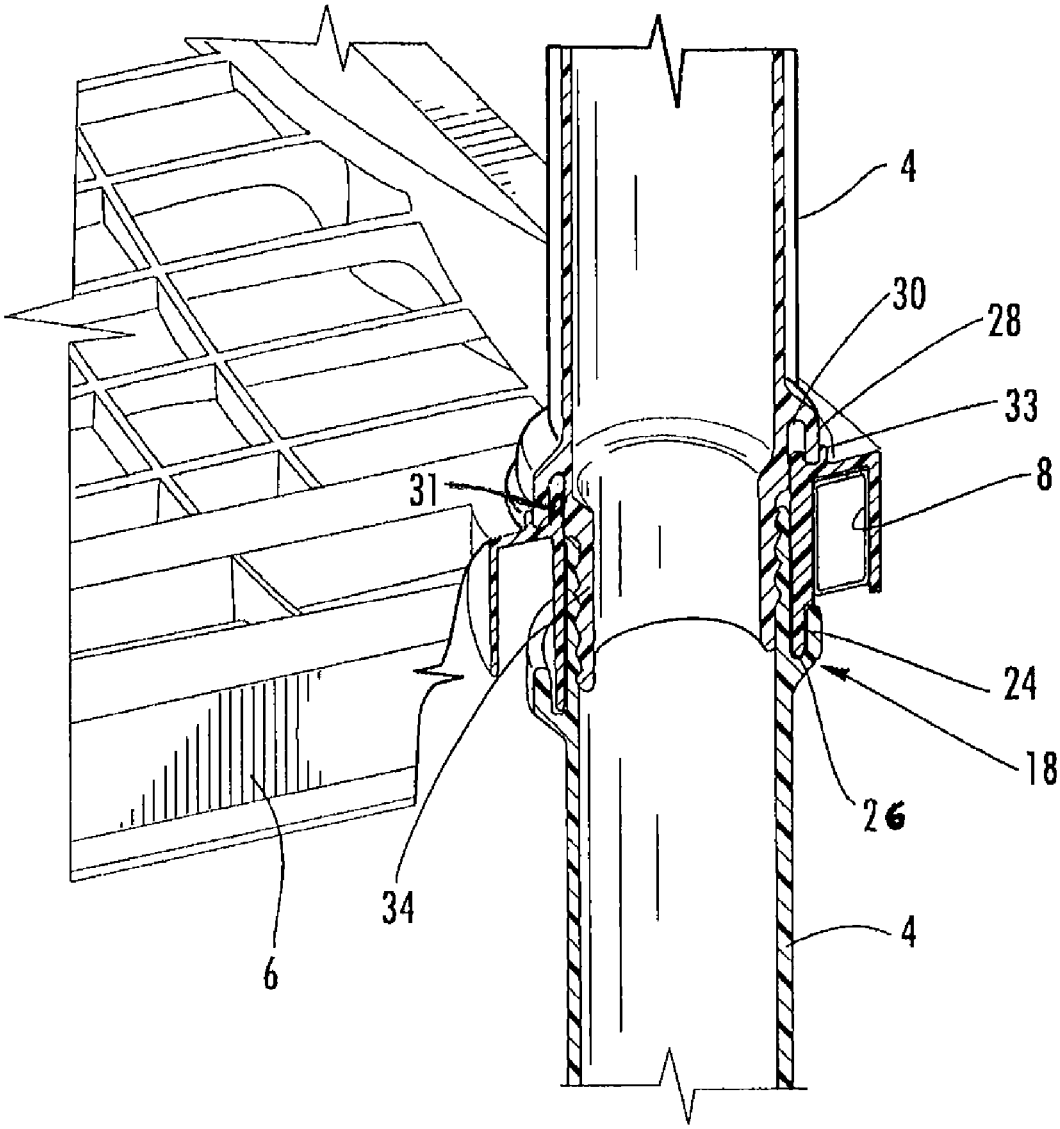
FIG. 9 is a detailed view showing the connection between a shelf and risers.
Figure 10:
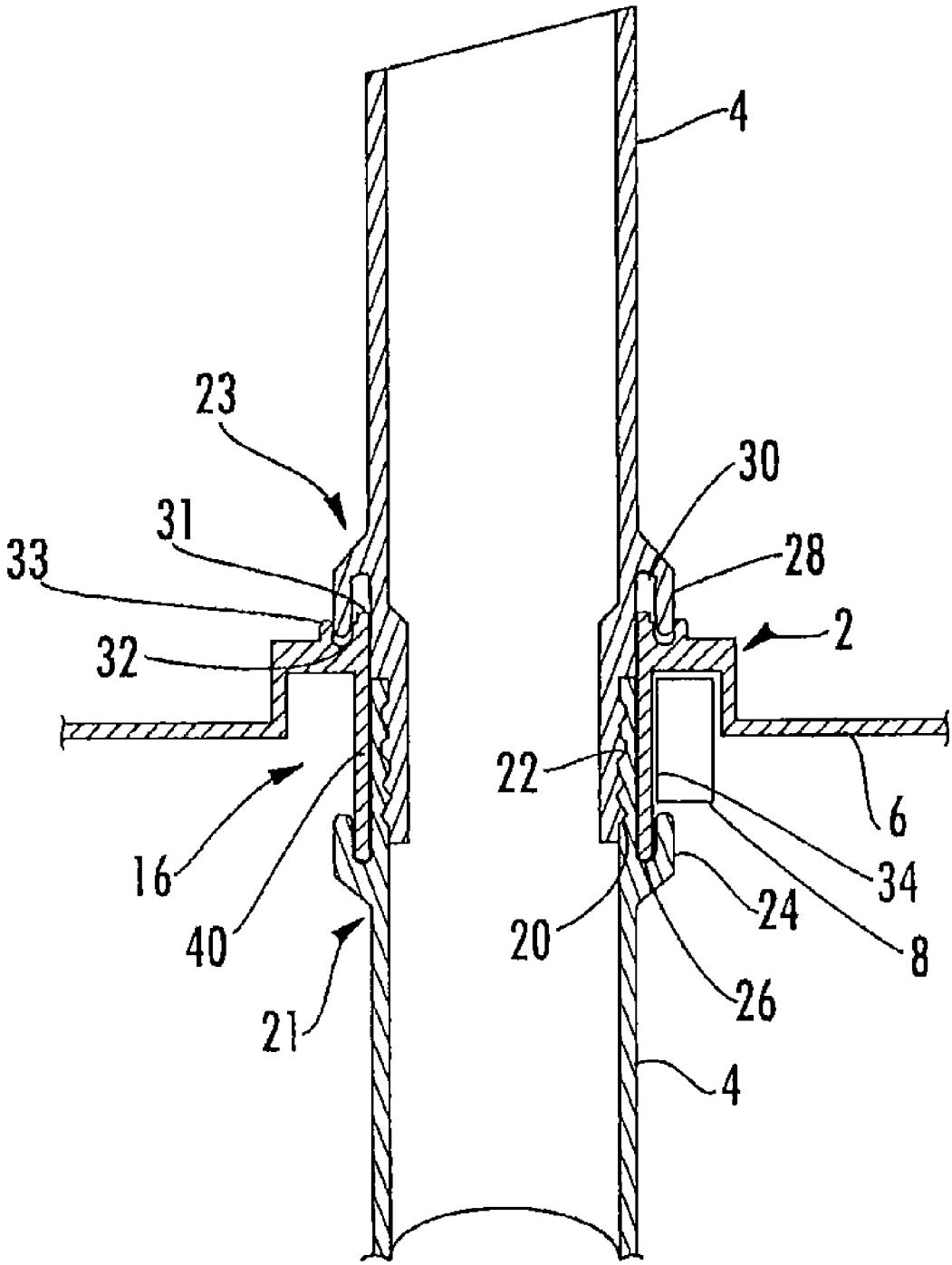
FIG. 10 is a section view showing the connection between a shelf and risers.

The connection between the risers 4 and the shelf 2 described below has applicability with shelves that have the shelf portion and reinforcement portions described above and to shelves having all resin construction. Thus, the connection between the risers and shelves may be used with all plastic shelves and is not limited to use with the shelves of the invention. Referring to FIGS. 8, 9 and 10 each riser 4 has a first end 21 that terminates in internal threads 20 and a second end 23 that terminates in mating external threads 22. Located around first end 21 is a first annular flange 24 that defines an annular cavity 26 that is open towards the end of the riser. Located around the second end 23 is a second annular flange 28 that defines an annular cavity 30 that is open toward the second end.

Each mounting aperture 16 defines a hole that extends through the shelf portion 6 and includes a first annular flange 31 and a second annular flange 33 that form a first annular cavity 32 that is open towards the top of shelf 2. A second annular flange 34 extends toward the bottom of shelf 2. The annular cavities 26 and 30 in the risers are dimensioned to receive the annular flanges 31 and 34 formed on the mounting aperture 18 and the annular cavity 32 formed in the mounting aperture is dimensioned to receive the annular flange 28 formed on the riser.

To assemble the shelving unit a first riser 4 is inserted into the top end of mounting aperture 18. A second riser 4 is inserted into the bottom end of the mounting aperture 18 such that the external threads 22 on the first riser engage the internal threads 20 on the second riser. The risers are rotated relative to one another such that as the threads tighten the risers are drawn toward one another. As the risers move towards one another the annular flange 28 from the first riser engages the first annular cavity 32 formed in the mounting aperture and the annular flange 34 of the mounting aperture 16 engages the annular cavity 26 formed in the second riser. As the threads tighten the flanges are forced into the respective cavities to clamp the risers to the shelf portion and to clamp shelf portions between the risers. The flanges and cavities may be dimensioned such that a tight friction fit is created between the contacting surfaces of the risers and shelf portions. Moreover, the plastic material may be deformed such that the flanges deform as increasing pressure is applied to create a compression fit between the components.

The above described construction locks the risers 4 to one another and to the shelf 2 such that the shelves and risers are rigidly joined together without the "play" found in friction fit shelving units. The use of flanges 24 and 28 also provides a wider area of contact between the risers and shelves than the diameter of the risers thereby creating a more rigid joint. Because the joint between the risers 4 and the shelves 2 is very rigid, the risers will not tilt relative to the shelves when a load is applied to the shelf. Thus, the load is transmitted along the longitudinal axis of the risers to maximize the load that can be supported without the risers buckling.

Figure 11:
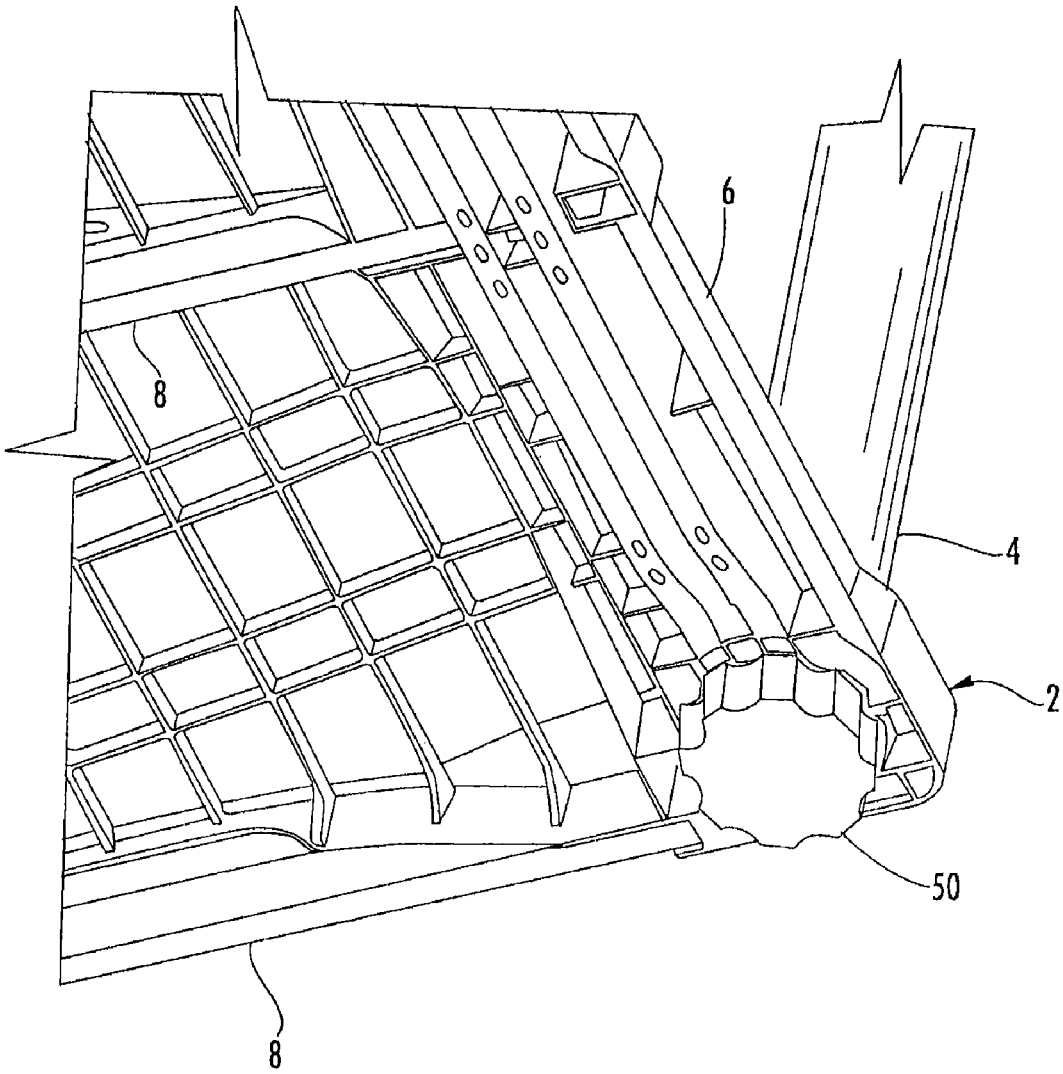
FIG. 11 is a detailed perspective view showing a portion of the bottom of the shelving unit of FIG. 1.
Figure 12:
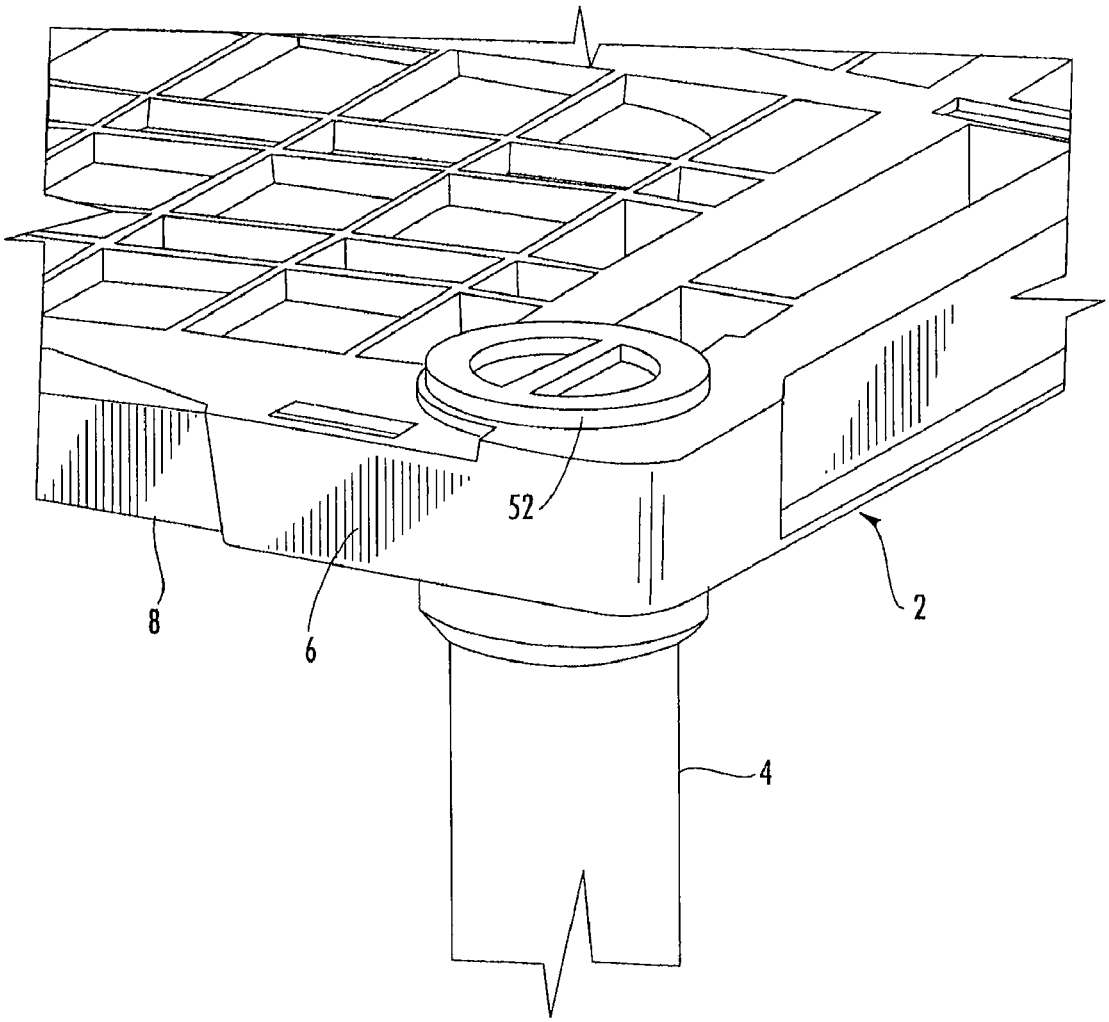
FIG. 12 is a detailed perspective view showing a portion of the top of the shelving unit of FIG. 1.

Feet 50 may be screwed onto risers 4 below the bottom shelf, as shown in FIG. 11, and caps 52 may be screwed onto threads 20 above the top shelf, as shown in FIG. 12, to complete the shelving unit. The internal structure of feet 50 and caps 52 are similar to the risers 4 as previously described such that the uppermost shelf is trapped between risers 4 and the cap 52 and the lowermost shelf is trapped between the risers and the feet 50.

Figure 14:
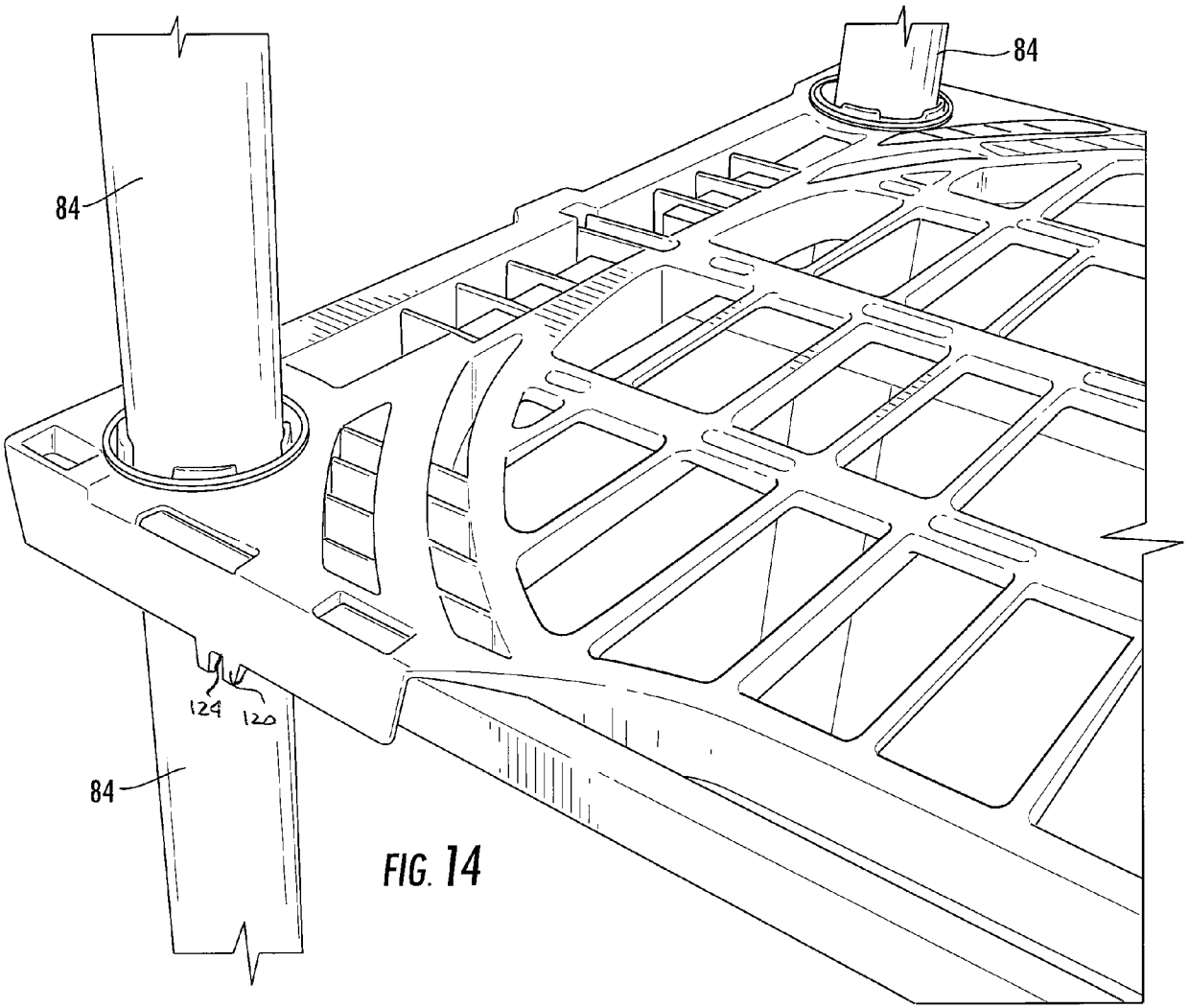
FIG. 14 is a perspective view of an alternate embodiment of the shelf and risers of the invention.
Figure 16:
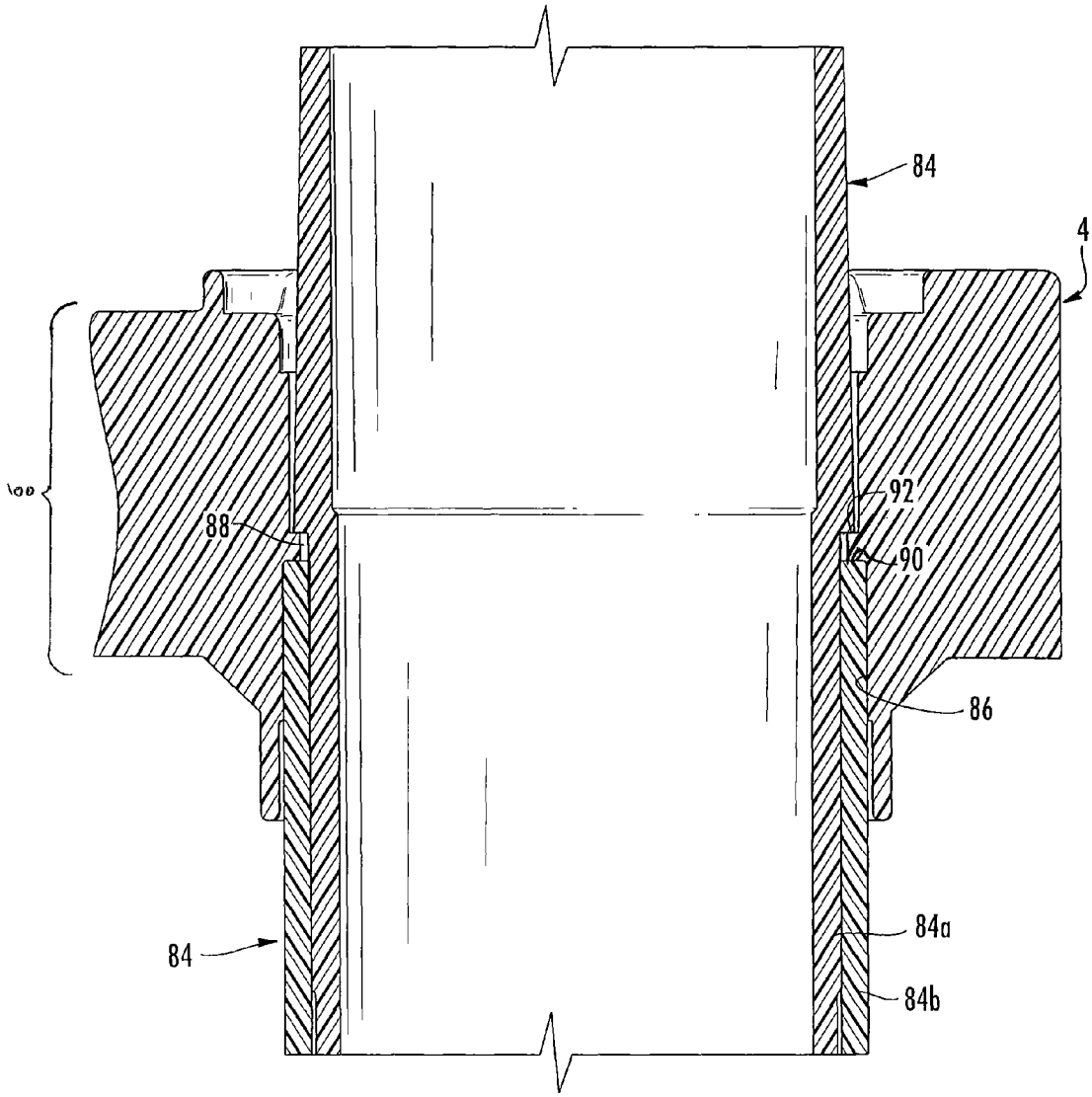
FIG. 16 is a partial section view of the risers and shelf of FIG. 14.

Referring to FIGS. 14 and 16, in an alternate embodiment the risers 84 each riser includes a first end 84*a* that is dimensioned to fit in the second end 84*b* of the mating riser. The external diameter of the first end 84*a* and the internal diameter of the second end 84*b* are selected such that a tight interference fit is created between the first end 84*a* of one riser and the and second end 84*b* of the mating riser. Further, the external diameter of the second end 84*b* is selected such that it creates a tight interference fit with the internal surface of the mounting apertures 86 formed in the shelf 2. Each mounting aperture 86 includes an annular rim 88 located at an approximate mid-point of the aperture such that the rim 88 is clamped between the distal edge surface 90 of the second end 84*b* and an annular flange 92 formed on the external surface of the first end 84*a*. To assemble the shelf 2 the tapered end of the reinforcement portion 8*a* is inserted into the channel 18 formed in the shelf portion 6 where an interference fit is created between the channel and the reinforcement portion.

Figure 15:
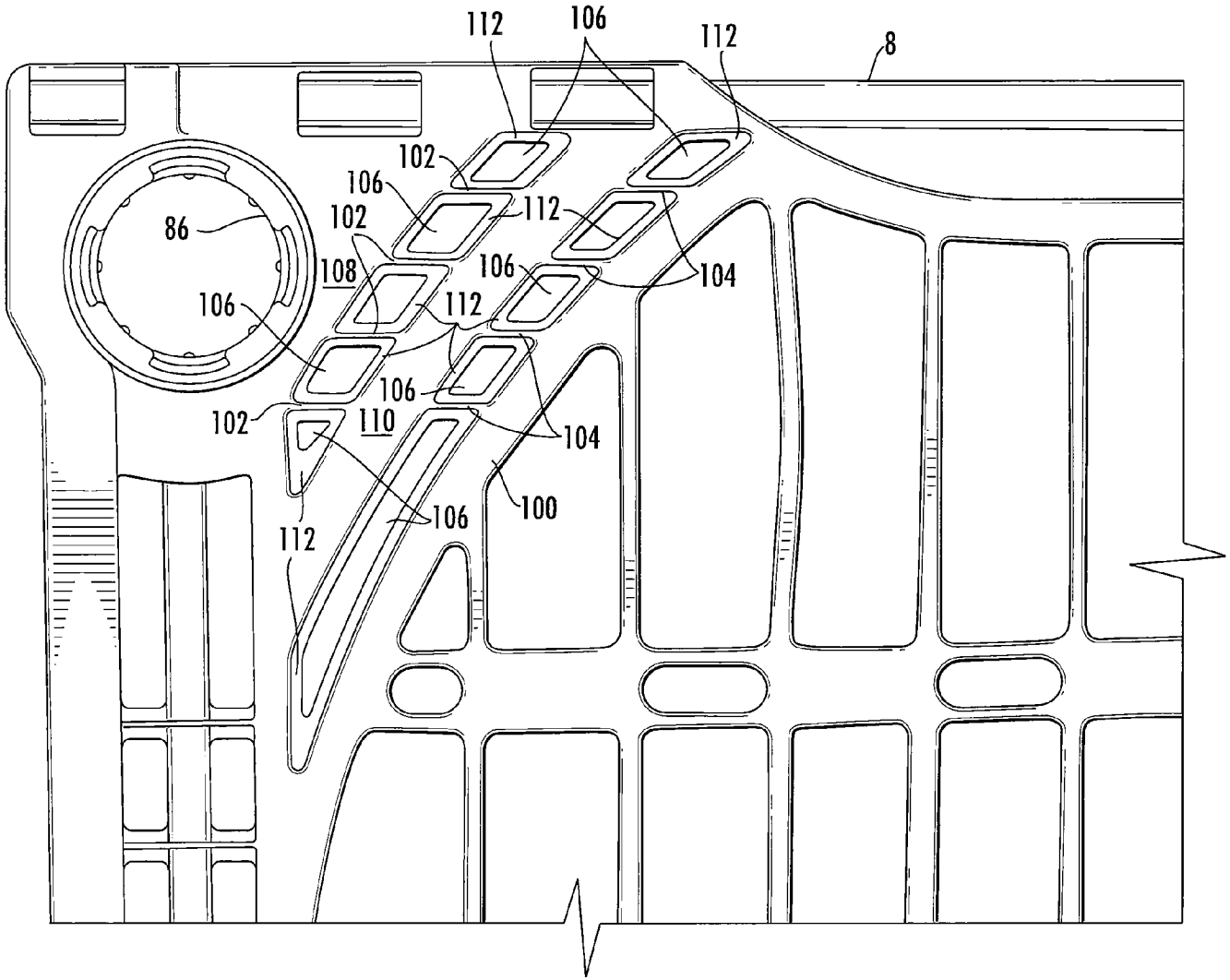
FIG. 15 is a partial top view of the shelf of FIG. 14.

In order to maintain the structural integrity of the connection between the risers 84 and the shelf 2, the area of the shelf 4 adjacent to the mounting aperture 86 is reinforced to prevent the shelf from bending in the area adjacent to the risers as best shown in FIGS. 14 and 15. The reinforcement is created by molding a thickened area 100 adjacent the mounting apertures 86. While only one aperture is shown in FIG. 15, it is to be understood that in a typical application four mounting apertures 86 will be used, where one mounting aperture is located near each corner of shelf 4. The thickened area 100 extends from adjacent the reinforcement portions 8 or 8*a* to an area adjacent the mounting aperture 86 toward the interior of the shelf 4. The thickened area 100 is created by a first row of ribs 102 and a second row of ribs 104. The ribs 102 and 104 extend the depth of the shelf 4 and are defined by apertures 106 that extend through the shelf. The first row of ribs 102 is spaced from the mounting aperture 86 by a solid plastic portion 108 and the second row of ribs 104 is spaced from the first row of ribs 102 by a solid plastic portion 110. Each of the ribs 102 and 104 include reinforcement flanges 112 that extend substantially perpendicularly from the ribs 102, 104 for the circumference of the apertures 106. The thickened solid plastic portions 108 and 110 and the ribs 102 and 104 make the shelf 4 more rigid in the area adjacent the risers 80 such that when a load is placed on the shelf, the shelf will not deflect in the area immediately adjacent the risers such that the risers will not easily deflect from their desired vertical alignment.

Figure 17:
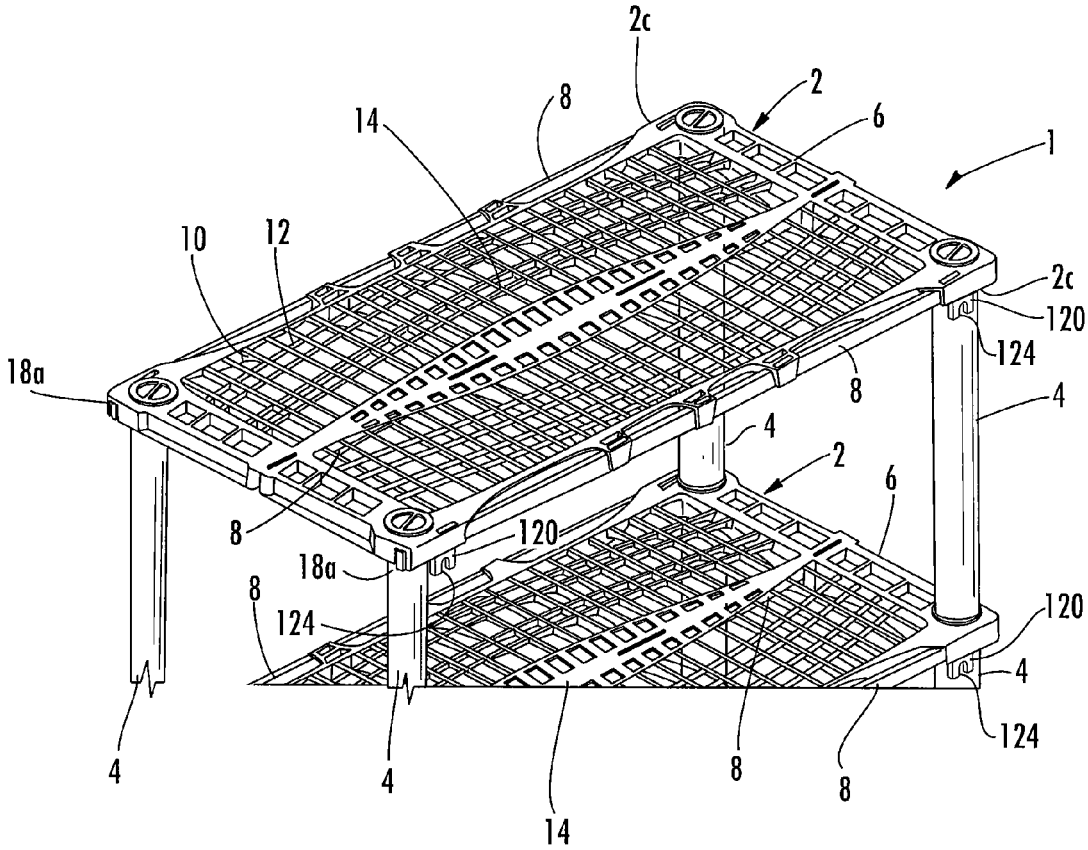
FIG. 17 is a partial perspective view of an alternate embodiment of the shelf.

Referring to FIGS. 14 and 17, shelf portion 6 includes a securement tab 120 formed integrally therewith. For example if shelf portion 6 is made of molded plastic, securement tab 120 is molded integrally therewith. In a preferred embodiment a plurality of securement tabs are formed along the back edge 2*d* of the shelf 2 so as to be substantially in line with the back of the shelving unit. The securement tabs 120 each include an aperture 122 for receiving a fastener such as a screw. The securement tabs may be dimensioned to extend below the bottom of the shelf to allow user access to the fastener. In use the shelving unit 1 is arranged with the back edge 2*d* of the shelf closely adjacent to or abutting a wall or other fixed support. Fasteners such as screws may be inserted into the apertures 122 to engage the wall or other support for fixing the shelving unit 1 to the wall or other fixed support. While in the illustrated embodiment apertures 122 are shown as open apertures that extend to the edge of securement tabs 120 the apertures may be through holes formed on the interior of the tabs. Further, while in the illustrated embodiment the securement tabs 120 are molded integrally with the shelf portion 6 they may be permanently fixed to the shelf by some other mechanism. The securement tabs may be formed on each shelf of the shelving unit or only on selected shelves.

Specific embodiments of an invention are described herein. One of ordinary skill in the art will recognize that the invention has other applications in other environments and that changes in the specific construction of the shelving unit may be made without departing from the invention. The following claims are in no way intended to limit the scope of the invention to the specific embodiments described above.

The invention claimed is:

1. A shelving unit comprising: a plurality of shelves comprising a plastic shelf portion each shelf portion having a front edge and a back edge and a plurality of apertures each for receiving a riser, and a first rigid reinforcement member and a second rigid reinforcement member each having a longitudinal axis, said first rigid reinforcement member and said second reinforcement member comprising a metal bar having a tapered portion extending along the longitudinal axis from a reduced cross-section at and end thereof to a full cross-sectional area of the metal bar such that the first reinforcement member is inserted into a plurality of aligned first channels and the second reinforcement member is inserted into a plurality of aligned second channels, said first rigid reinforcement member and said second reinforcement member extending substantially from one edge of the shelf portion to an opposite edge of the shelf portion; said first channels being disposed along said front edge and said second channels being disposed along said back edge where each of said plurality of first channels are dimensioned to substantially surround and closely receive said first rigid reinforcement member and each of said plurality of second channels are dimensioned to substantially surround and closely receive said second rigid reinforcement member wherein one of said first channels is located closely adjacent to one of said plurality of apertures and one of said second channels is located closely adjacent to an another one of said plurality of apertures; and a plurality of risers located in said plurality of apertures connecting the plurality of shelves together.

2. The shelving unit of claim 1 wherein the reinforcement member is a bar.

3. The shelving unit of claim 2 wherein the bar has a rectangular profile.

4. The shelving unit of claim 2 wherein the bar has an I-beam profile.

5. The shelving unit of claim 1 wherein the reinforcement member is made of metal.

6. The shelving unit of claim 1 wherein the first reinforcement member is inserted into the plurality of aligned first channels.

7. The shelving unit of claim 1 wherein the risers are hollow.

8. The shelving unit of claim 1 wherein the risers are formed of plastic.

9. The shelving unit of claim 1 wherein a first one of the plurality of risers engages a second one of the plurality of risers with an interference fit.

10. The shelving unit of claim 9 wherein a shelf portion is clamped between the first one of the plurality of risers and the second one of the plurality of risers.

11. The shelving unit of claim 1 wherein a first plurality of the plurality of risers are located between two of the plurality of shelf portions.

12. The shelving unit of claim 1 wherein the shelf includes a reinforced portion adjacent each of said plurality of risers, said reinforced portion including a plurality of ribs formed integrally with said shelf.

13. The shelving unit of claim 1 further including a securement tab integrally connected to said shelf portion.

14. The shelving unit of claim 13 wherein said securement tab includes an aperture for receiving a fastener.

15. The shelving unit of claim 13 wherein the securement tab is arranged so as to be substantially aligned with the back of the shelving unit.

* * * * *